US006138635A

United States Patent [19]

Walker

[11] Patent Number: 6,138,635

[45] Date of Patent: Oct. 31, 2000

[54] MODULAR ENGINE HAVING CRANKSHAFT SEGMENTS CONNECTED BY A SPRING TO PROVIDE EVEN FIRING

[76] Inventor: Frank H. Walker, 8087 Hawkcrest Dr., Grand Blanc, Mich. 48439

[21] Appl. No.: 09/315,168

[22] Filed: May 20, 1999

Related U.S. Application Data

[60] Provisional application No. 60/086,180, May 20, 1998.

[51] Int. Cl.[7] ..... F02B 77/00

[52] U.S. Cl. ..... 123/198 F

[58] Field of Search ..... 123/198 F, 197.4, 123/DIG. 8; 192/53 B

[56] References Cited

U.S. PATENT DOCUMENTS

| | | | |
|---|---|---|---|
| 4,367,704 | 1/1983 | Maucher et al. . | |
| 4,368,701 | 1/1983 | Huber et al. . | |
| 4,373,481 | 2/1983 | Kriiger et al. . | |
| 4,722,308 | 2/1988 | Wall . | |
| 5,092,293 | 3/1992 | Kaniut . | |
| 5,156,122 | 10/1992 | Kaniut | 123/198 F |

*Primary Examiner*—Willis R. Wolfe
*Assistant Examiner*—Hyder Ali
*Attorney, Agent, or Firm*—Brooks & Kushman P.C.

[57] ABSTRACT

An internal combustion engine includes three engine modules. Each engine module having an associated crankshaft segment. A first clutch is provided for connecting the first crankshaft segment to the second crankshaft segment such that the first and second crankshafts are indexed at 90° with respect to one another. A second clutch is provided for connecting the second crankshaft segment to the third crankshaft segment such that the second and third crankshaft segments are indexed at 90° with respect to one another. A spring connects the first crankshaft segment via the first clutch to the second crankshaft segment. The spring winds to cause the second crankshaft segment to lag behind the first crankshaft segment 30° such that the first, second, and third crankshafts rotate at 60° intervals with respect to one another when the first, second, and third engine modules are in operation and the first, second, and third crankshafts are connected. The spring also causes the first and second crankshafts to remain indexed at 90° with respect to one another when the first and second engine modules are in operation and the first and second crankshafts are connected and the third crankshaft is disconnected from the second crankshaft.

5 Claims, 1 Drawing Sheet

MODULAR ENGINE HAVING CRANKSHAFT SEGMENTS CONNECTED BY A SPRING TO PROVIDE EVEN FIRING

CROSS-REFERENCE TO RELATED APPLICATION

This is a continuation of Provisional Application No. 60/086,180, filed May 20, 1998.

TECHNICAL FIELD

The present invention relates generally to an engine having separate crankshaft segments and, more particularly, to a modular engine having crankshaft segments connected by a torsion spring to provide even firing.

BACKGROUND ART

Hybrid powertrain systems are defined as having more than one source of power to accomplish the task of propelling and accelerating an automotive vehicle. Dividing an engine into independently operating modules accomplishes this task, without the cost, complication, and inefficiency of storing and converting energy such as is done with other hybrid systems such as electric hybrids. An engine having independent modules overcomes the major causes of inefficiency by allowing the independent operation of two, four, or six cylinders in a six cylinder engine.

The important considerations in the design of a modular engine include the following. Optimizing fuel efficiency factors such as maximizing thermal efficiency and reducing mechanical friction. Meeting emission targets from the combustion chamber and proper treatment of exhaust gases. Smoothing the torque pulses from the cylinder firing with a low number of operating cylinders or an unconventional firing sequence. Coping with primary and higher order unbalance forces by positioning of the cylinders and use of auxiliary balancing schemes. Meeting cost and mass targets. Being compatible with the latest industry technology breakthroughs such as free breathing, variable valve timing, new materials, and closed loop fuel and ignition controls.

Two stroke engine technology is attractive for a modular engine having separate modules because the one-per-revolution firing frequency smooths torque pulses for a two cylinder operating module. Cylinder ports for controlling the opening of air inlet and exhaust outlet passages greatly simplifies engine construction by eliminating much or all of the conventional valve gear. However, optimizing fuel efficiency and emissions possibly requires some form of variable valve timing, so some controllable augmentation to the port opening timing may be needed through rotary or poppit valves. These valves are actuated mechanically, electrically, or electro-hydraulically.

A modular engine consists of separate engine modules. Each module includes at least one cylinder with a piston and a connecting rod attached to a crankshaft segment. Each crankshaft segment of a module is connected to a crankshaft segment of another engine module by a clutch. The clutch is typically a one way clutch generally referred to as a mechanical diode.

The clutch allows angular indexing of the crankshaft segments and the engine modules to a specific angular position to minimize torque pulses. For instance, an engine may have first and second engine modules with each engine module having two cylinders. To convert from a two cylinder even firing engine module at 180° firing intervals to a four cylinder even firing engine module pair at 90° firing intervals, the crankshaft segments of each of the two engine modules have to be linked to index the crankshaft segments at 90° rotation intervals.

A problem is that to add a third engine module to the previous two engine modules, it is necessary to have the firing intervals be at 60° between the three engine modules. However, the crankshaft segment of the third engine module is linked to the crankshaft segment of a second engine module to index the second and third crankshaft segments at 90° rotation intervals to provide even firing when the second and third engine modules are operable and the first module is inoperable. In the above described scenario, first and second engine modules provide proper firing when the third engine module is inoperable because their crankshaft segments are at 90° rotation intervals. Second and third engine modules provide proper firing when the first engine module is inoperable because their crankshaft segments are at 90° rotation intervals. However, first, second, and third engine modules provide improper firing when they are all operable because their crankshaft segments are not at 60° rotation intervals.

A similar condition exists with four stroke engines except that firing intervals are 360° for a two cylinder engine, 180° for a four cylinder engine, and 120° for a six cylinder engine. What is needed is a modular engine having at least three engine modules in which the crankshaft segments of the engine modules are connected by a torsion spring to provide even firing between the engine modules.

SUMMARY OF THE INVENTION

Accordingly, it is an object of the present invention to provide a modular engine having at least three engine modules in which the crankshaft segments of the engine modules are connected by a torsion spring to provide even firing between the engine modules.

In carrying out the above object and other objects, the present invention provides an internal combustion engine. The engine includes three engine modules. Each engine module has two cylinders. Each of the two cylinders has an associated piston and connecting rod. A first crankshaft segment connects to the connecting rods of the first engine module. The first crankshaft segment rotates when the first engine module is in operation. A second crankshaft segment connects to the connecting rods of the second engine module. The second crankshaft segment rotates when the second engine module is in operation. A third crankshaft segment connects to the connecting rods of the third engine module. The third crankshaft segment rotates when the third engine module is in operation.

A first clutch is provided for connecting the first crankshaft segment to the second crankshaft segment such that the first and second crankshafts are indexed at 90° with respect to one another. A second clutch is provided for connecting the second crankshaft segment to the third crankshaft segment such that the second and third crankshaft segments are indexed at 90° with respect to one another. A spring connects the first crankshaft segment via the first clutch to the second crankshaft segment. The spring winds to cause the second crankshaft segment to lag behind the first crankshaft segment 30° such that the first, second, and third crankshafts rotate at 60° intervals with respect to one another when the first, second, and third engine modules are in operation and the first, second, and third crankshafts are connected. The spring causes the first and second crankshafts to remain indexed at 90° with respect to one another when the first and second engine modules are in operation and the first and second crankshafts are connected and the third crankshaft is disconnected from the second crankshaft.

The above objects and other objects, features, and advantages embodiments of the present invention are readily apparent from the following detailed description of the best mode for carrying out the present invention when taken in connection with the accompanying drawings.

BEST MODES FOR CARRYING OUT THE INVENTION

Figure 1:
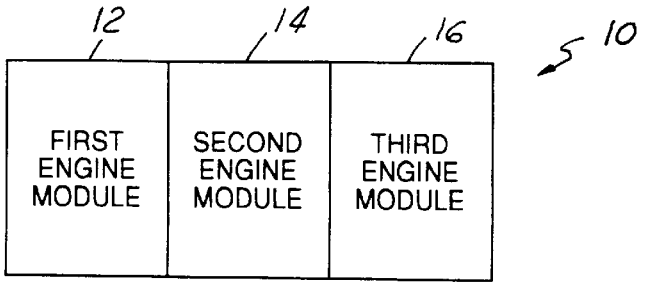
FIG. 1 illustrates a block diagram of an internal combustion engine in accordance with the present invention.

Referring now to FIG. 1, an internal combustion engine 10 in accordance with the present invention is shown. Engine 10 includes at least three engine modules: a first engine module 12, a second engine module 14, and a third engine module 16. Engine modules 12, 14, and 16 are separate and independent from one another. Engine modules 12, 14, 16 may all be operative at one time or some of the engine modules may be disabled while the other engine modules are enabled. An advantage of having independent engine modules is that some engine modules may be disabled when a relatively greater amount of power is not needed to move a vehicle. For example, while the vehicle is at a steady speed. All of the engine modules may be enabled when a relatively greater amount of power is needed. For example, when the vehicle is accelerating.

Figure 2:
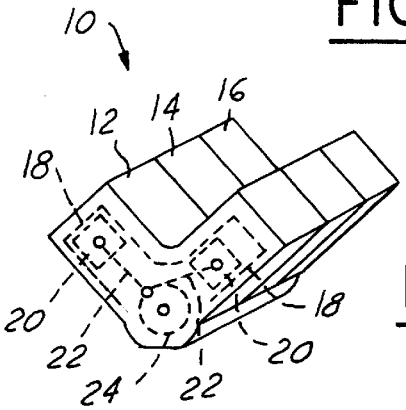
FIG. 2 illustrates the cylinders, pistons, and connecting rods of each of the engine modules of the engine.

Referring now to FIG. 2, each of engine modules 12, 14, and 16 have identical elements and only engine module 12 will be described in further detail with respect to FIG. 2. Engine module 12 includes two cylinders 18 and 20. Each of cylinders 18 have an associated piston 20 connected to an associated connecting rod 22. Each connecting rod 22 is connected to a rotatable crankshaft 24.

Figure 3:
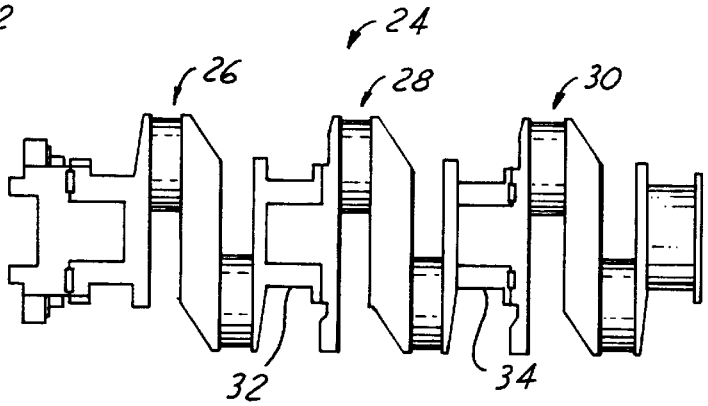
FIG. 3 illustrates a crankshaft having separate crankshaft segments.

Referring now to FIG. 3, crankshaft 24 includes three crankshaft segments 26, 28, and 30 each associated with a respective one of the engine modules 12, 14, and 16. The two connecting rods 22 of first engine module 12 are connected to first crankshaft segment 26 and first crankshaft segment 26 rotates when first engine module 12 is in operation. Similarly, the two connecting rods 22 of second engine module are connected to crankshaft segment 28 and second crankshaft segment 28 rotates when second engine module 14 is in operation. Likewise, third crankshaft segment is similarly operable with third engine module 16.

A first clutch 32 is provided for connecting first crankshaft segment 26 to second crankshaft segment 28. First clutch 32 connects first and second crankshaft segments 26 and 28 such that the first and second crankshafts are indexed at 90° with respect to one another. A second clutch 34 is provided for connecting second crankshaft segment 28 to third crankshaft segment 30. Second clutch 34 connects second and third crankshaft segments 28 and 30 such that the second and third crankshafts are indexed at 90° with respect to one another.

Figure 4:
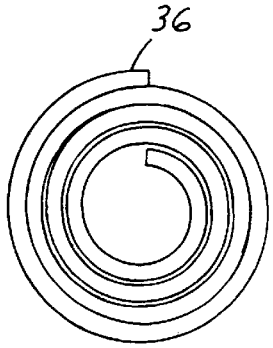
FIG. 4 illustrates a first embodiment of a torsion spring for connecting the first and second crankshaft segments.
Figure 5:
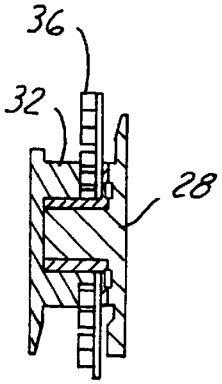
FIG. 5 illustrates the torsion spring shown in FIG. 4 connecting the first and second crankshaft segments.

Referring now to FIGS. 4–5, engine 10 in accordance with the present invention further includes a spring 36 for connecting first crankshaft segment 26 via first clutch 32 to second crankshaft segment 28. Spring 36 includes mechanical stops at both of its ends of allowed travel. When spring 36 is connected between first clutch 32 and second crankshaft 28, first and second engine modules 26 and 28 transmit torque through the spring.

In operation, spring 36 winds to cause second crankshaft segment 28 to lag behind first crankshaft segment 26 by 30° such that first, second, and third crankshafts 26, 28, and 30 rotate at 60° intervals with respect to one another when first, second, and third engine modules 12, 14, and 16 are in operation and the first, second, and third crankshafts are connected. In essence, spring 36 makes second engine module 14 lag behind first engine module 12 by an additional 30°, thus opening a space and allowing third engine module 16 to enter at 60° ahead of the second engine module to accomplish even firing. Even firing is obtained because first, second, and third engine modules fire at 60° intervals. In this case, spring 36 transmits the torque of second and third engine modules 14 and 16 (twice the torque).

Spring 36 causes first and second crankshafts 26 and 28 to remain indexed at 90° with respect to one another when first and second engine modules 12 and 14 are in operation and the first and second crankshafts are connected and third crankshaft 30 is disconnected from the second crankshaft. In this case, spring 36 transmits the torque of only second engine module 14.

Figure 6:
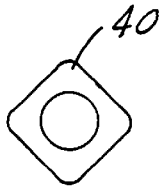
FIG. 6 illustrates a second embodiment of a torsion spring for connecting the first and second crankshaft segments.
Figure 7:
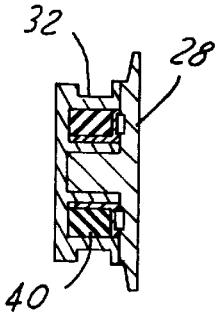
FIG. 7 illustrates the torsion spring shown in FIG. 6 for connecting the first and second crankshaft segments.

As shown in FIG. 4, spring 36 may be a spiral wound spring made of metal. As shown in FIG. 6, the spring may be a torsion spring 40 made of rubber.

Thus it is apparent that there has been provided, in accordance with the present invention, an internal combustion engine that fully satisfies the objects, aims, and advantages set forth above. While the present invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. An internal combustion engine comprising:

three engine modules, each engine module having two cylinders, each of the two cylinders having an associated piston and connecting rod;

a first crankshaft segment connected to the connecting rods of the first engine module, the first crankshaft segment rotating when the first engine module is in operation;

a second crankshaft segment connected to the connecting rods of the second engine module, the second crankshaft segment rotating when the second engine module is in operation;

a third crankshaft segment connected to the connecting rods of the third engine module, the third crankshaft segment rotating when the third engine module is in operation;

a first clutch for connecting the first crankshaft segment to the second crankshaft segment such that the first and second crankshafts are indexed at 90° with respect to one another;

a second clutch for connecting the second crankshaft segment to the third crankshaft segment such that the second and third crankshaft segments are indexed at 90° with respect to one another; and a spiral wound spring connecting the first crankshaft segment via the first clutch to the second crankshaft segment, wherein the spiral wound spring winds to cause the second crankshaft segment to lag behind the first crankshaft segment 30° such that the first, second, and third crankshafts rotate at 60° intervals with respect to one another when the first, second, and third engine modules are in operation and the first, second, and third crankshafts are connected.

2. The engine of claim 1 wherein:

the spiral wound spring causes the first and second crankshafts to remain indexed at 90° with respect to one another when the first and second engine modules are in operation and the first and second crankshafts are connected and the third crankshaft is disconnected from the second crankshaft.

3. The engine of claim 1 wherein:

the spiral wound spring includes metal.

4. An internal combustion engine comprising:

three engine modules, each engine module having two cylinders, each of the two cylinders having an associated piston and connecting rod;

a first crankshaft segment connected to the connecting rods of the first engine module, the first crankshaft segment rotating when the first engine module is in operation;

a second crankshaft segment connected to the connecting rods of the second engine module, the second crankshaft segment rotating when the second engine module is in operation;

a third crankshaft segment connected to the connecting rods of the third engine module, the third crankshaft segment rotating when the third engine module is in operation;

a first clutch for connecting the first crankshaft segment to the second crankshaft segment such that the first and second crankshafts are indexed at a first angle with respect to one another;

a second clutch for connecting the second crankshaft segment to the third crankshaft segment such that the second and third crankshaft segments are indexed at the first angle with respect to one another; and a spiral wound spring connecting the first crankshaft segment via the first clutch to the second crankshaft segment, wherein the spiral wound spring winds to cause the second crankshaft segment to lag behind the first crankshaft segment at a second angle smaller than the first angle such that the first, second, and third crankshafts rotate at angle intervals with respect to one another such that the engine modules have even firing when the first, second, and third engine modules are in operation and the first, second, and third crankshafts are connected.

5. The internal combustion engine of claim 4 wherein:

the first, second, and third crankshafts rotate at 60° intervals with respect to one another such that the engine modules have even firing when the first, second, and third engine modules are in operation and the first, second, and third crankshafts are connected.

* * * * *